US005564494A

United States Patent [19]

Salminen

[11] Patent Number: 5,564,494

[45] Date of Patent: Oct. 15, 1996

[54] PROCESSING ROLL APPARATUS AND METHOD

[76] Inventor: Reijo K. Salminen, 373 Cove Rd., Bellingham, Wash. 98226

[21] Appl. No.: 291,115

[22] Filed: Aug. 16, 1994

[51] Int. Cl.[6] ..... F28F 5/02

[52] U.S. Cl. ..... 165/89; 34/125; 492/46

[58] Field of Search ..... 165/890; 100/93 RP; 34/125; 162/290, 296; 492/46

[56] References Cited

U.S. PATENT DOCUMENTS

| | | | |
|---|---|---|---|
| 2,170,405 | 8/1939 | Greenwood | 34/125 X |
| 2,521,371 | 9/1950 | Hornbostel et al. | 165/89 X |
| 3,481,050 | 12/1969 | Cox, Jr. | 165/89 X |
| 4,155,177 | 5/1979 | Justus | 165/89 X |
| 4,538,360 | 9/1985 | Chance et al. | 165/89 X |

*Primary Examiner*—John C. Fox

*Attorney, Agent, or Firm*—Robert B. Hughes; Hughes, Multer & Schacht

[57] ABSTRACT

A processing roll adapted to engage paper or the like to heat and/or shape the same. The roll has a cylindrical side wall and defines a interior condensing chamber for steam. The interior surface of the roll is formed with longitudinal grooves which slope away from the longitudinal axis toward a central location. The steam condensates in the chamber, collects in the grooves, and flows toward a center location where the condensate is siphoned out and removed from the chamber. Improved heat transfer is achieved, and greater uniformity of heat is accomplished at the outside surface.

24 Claims, 11 Drawing Sheets

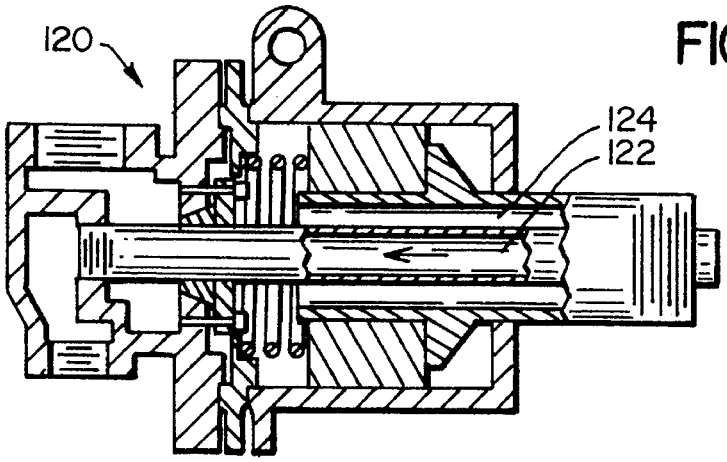
FIG. 16
FIG. 17
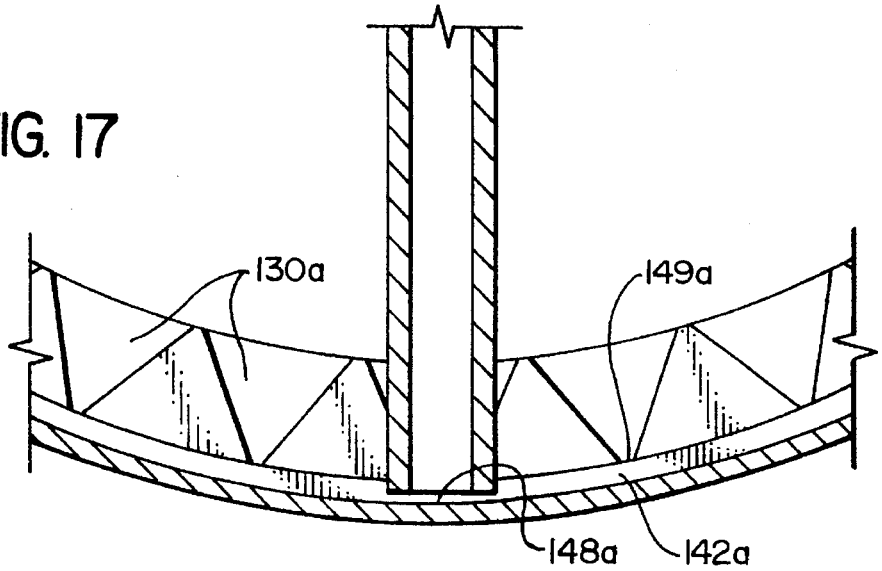
FIG. 18
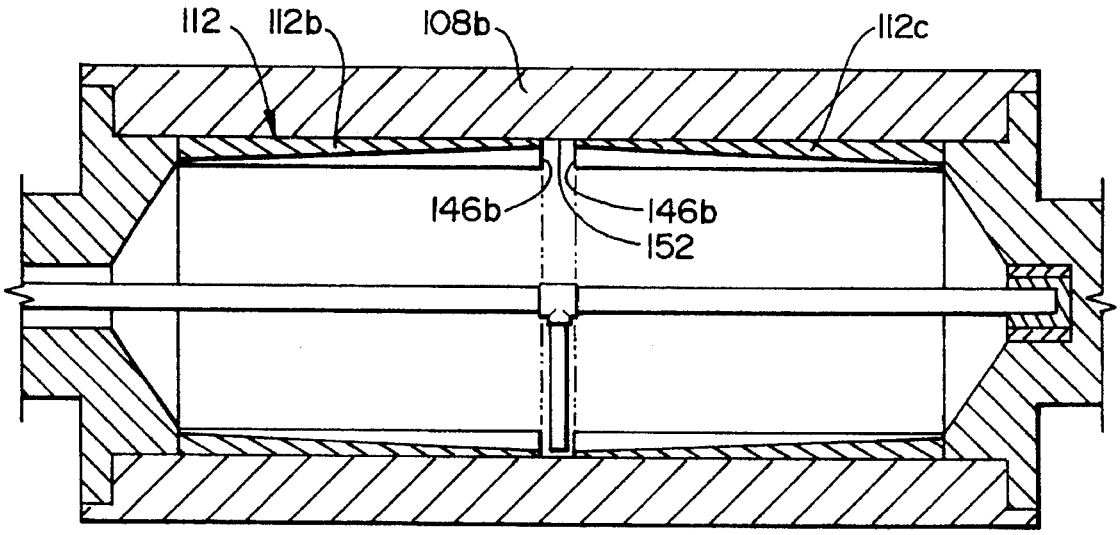

PROCESSING ROLL APPARATUS AND METHOD

The present invention relates to a processing roll apparatus and method arranged to engage a material to be processed in heat exchange relationship, and more particularly to such an apparatus and method where the roll defines an enclosed chamber to contain a condensable heat transfer medium to transmit heat to the outside surface of the roll, such as a roll that is used in the pulp and paper industry to engage paper sheets and/or corrugating medium (i.e. a continuous web of paper formed into a corrugated shape) to heat and/or shape the same.

BACKGROUND OF THE INVENTION

There are various industrial applications where cylindrical rolls are used for such things as forming and/or drying sheet material, such as paper, pulp or corrugating medium. One specific application for such rolls is to form corrugated paper which is then bonded to upper and lower paper web to form a corrugated sandwich structure (cardboard). The exterior surface of the roll is made with longitudinally aligned ridges separated by recessed portions or grooves. The interior surface of the roll defines a closed chamber which is pressurized with a condensable heat transfer medium which is generally steam.

In operation pressurized steam is directed through an inlet which is commonly formed at an end wall of the roll with a rotary pressure seal, with the steam being at a temperature and pressure as high as possibly 400° F. and 200 pounds per square inch. As the steam condenses on the interior surface of the cylindrical side wall of the roll it transmits heat through the side wall and thus heats the paper or cardboard which is in contact with the roll side wall. As the steam condenses on the interior surface, the water is removed from the chamber by a siphon pipe or other removal mechanism and discharged through an outlet which can have a rotary seal joint.

A common arrangement for corrugating rolls is for a set of three rolls to be horizontally aligned, one above the other, with the elongate ridge portions of each roll fitting into the matching valley or recessed portions of the other roll. As these rolls are rotated, the paper or web is fed into the region between the rolls to have heat applied thereto and to be formed in a corrugated pattern. As the resulting corrugated sheet moves from the location between the rolls, it is then bonded to upper and lower paper web to form a corrugated sandwich structure.

By way of further background information, various heat transfer media for this type of rolls have been tried in the past, but substantially all cylinders or rolls used for heating, drying or forming pulp or paper are generally heated by steam condensing on the inner surface of the roll that defines a closed pressure chamber. However, there are possible alternatives to using steam, for example, organic vapors such as Dowtherm and special heat transfer oils. The heat transfer coefficient for film type condensation of steam on stationary surfaces ranges from one thousand to three thousand BTU/(hr) (square feet of surface) (°F.) difference in temperature between the steam and the surface being heated). The corresponding range for organic vapors is 200 to 300 and for oils 10 to 30.

Condensation is a constant temperature process, with the temperature depending upon the pressure. Because the internal volume of the roll is large compared with the rate of steam flow, the pressure is constant throughout. Thus, (provided there are no noncondensable gases) the heat leaves the steam at the same temperature at all points throughout the inner surface of the shell, thus, helping to maintain uniform heat transfer and drying at the water surface of the roll.

As the steam condenses on the interior surface of the roll, heat is transferred first from the steam to the condensate film, then through the film to the metal wall that forms the roll. If the steam is super heated, its temperature will drop before it condenses, but condensation will occur at the same temperature as though it had been saturated at the same pressure. Researchers have established that with about 180° F. super heat the rate of heat transfer to a given area is only about three percent more than for saturated steam at the same pressure.

The ideal steam supply and condensate removal system should supply pure steam (no noncondensables) and maintain a thin, uniform condensate film. If noncondensables are present, and if liquid condensate alone is discharged from the cylinder, the noncondensables accumulate. Since the presence of noncondensable gas reduce the heat transfer capacity and uniformity, special consideration should be given to insuring that the noncondensable gases are not allowed to accumulate. This can be accomplished in various ways. For example, by "blowing through" perhaps twenty percent of the steam supply with the condensate, a steam velocity high enough to purge noncondensables from the entire chamber within the roll can usually be achieved.

Certain special problems must be taken into account in applying well known heat transfer data and steam technology to steam heated rolls. Let it be assumed that the roll is stationary, pressurized steam is being fed into the roll, and a certain amount of condensate (liquid water) has formed and rests on the lower part of the interior surface.

As a roll begins to rotate, this tends to move the condensate in the direction of rotation of the roll; inertial forces tend to retard any change in motion of the condensate; centrifugal forces tend to hold the condensate against the inner periphery of the cylinder; and gravity tends to pull the condensate to the bottom of the cylinder. At very low speeds, the gravitational forces cause the condensate to run down the cylindrical side wall in a thin film that forms a puddle at the bottom of the roll. At slightly higher speeds, the viscous forces drag some of the condensate from the puddle part way up the ascending side wall of roll, but it continues to run down to the puddle. As the speed increases still further, the condensate is dragged higher up the interior surface of the side wall, and centrifugal forces hold the condensate to the side wall in the upper quadrant of the ascending side wall. However, gravity still prevails, and the condensate breaks away from the cylinder wall and "cascades" back to the bottom of the dryer.

The rimming condition is achieved when the centrifugal force becomes sufficiently greater than gravity, allowing the condensate to "go over the top". The speed at which this occurs is greatly dependant upon the amount of condensate present in the dryer, a thin layer being rimmed at a slower speed than a thicker layer. However, on the ascending and descending walls of the cylinder, gravity respectively decelerates and accelerates the condensate layer. This results in a condensate layer that is thickest at the top and thinnest at the bottom and in a relative motion of the condensate (with respect to the side wall) best described as "sloshing". At speeds just above the rimming speed, sloshing is considerable. As the speed is increased, the sloshing diminishes, until, at very high speeds, where the gravitational force is overwhelmed by the centrifugal force, sloshing becomes almost negligible.

Fluid flow within the roll has a marked effect on the heat transfer properties of the condensate. Under non-rimming conditions, droplets of condensations can form on the upper portions on the inner roll surface. With dropwise condensation there is no film, and droplets of condensate form and flow in rivulets in the puddle. There is much less resistance to heat transfer from the steam to the metal than with film condensation. The general requirement for dropwise condensation is a non-wettable surface.

Under rimming conditions, heat transfer is governed both by the thickness of the condensate and by fluid flow characteristics. The thinner the layer and more turbulent the flow, the less the resistance to heat transfer. Thickness of the condensate depends on the design, size, location and clearance of the siphon which extracts the condensate from the interior of the roll, roll speed and diameter, condensating rate and differential pressure. Turbulence depends on the condensate thickness and roll speed and diameter. Minimizing the condensate thickness, although resulting in a minimum of turbulence, will result in a lower resistance to, and greater uniformity of, heat transfer.

To illustrate one of the significant problems in operating such steam heated rolls, let us take the example of a paper corrugating operation where a quantity of paper is being fed between a set of two rolls. The steam in the rolls is at a predetermined pressure and temperature, and as indicated above, with the rolls being rotated at a sufficiently high speed, the condensate that has formed will reach a "rimming" condition where the liquid is distributed substantially uniformly (by centrifugal force) against the interior surface of the cylindrical side wall of the roll. In this condition, with the temperature within the roll being substantially uniform throughout and with heat transfer being substantially uniform through all areas of the cylindrical side wall, the temperature of the outside surface of the cylindrical side wall is substantially uniform over the entire outer surface of the side wall.

However, let it now be assumed that it is desired to feed a different size or type of paper sheet through the corrugating rolls. It is necessary to stop the rolls, and it may take approximately five minutes or so (with the rolls being stationary to make the change over to feed the second paper material through the rolls. During this approximate five minute or so changeover time, the condensate (i.e. water) will have accumulated at the bottom part of the roll, and may reach a depth of, for example, ¼ inch or greater at the lowest point in the interior surface of the roll. Since liquid water is a relatively poor conductor of heat, that portion of the cylindrical wall of the roll that is beneath the liquid water that has accumulated in the bottom of the roll experiences a significant temperature drop in comparison with the other portions of the side wall of the roll (e.g. possibly several 10° F.). This uneven temperature will cause the roll to be distorted out of a perfectly round shape.

Thus, when the rolls are again starting to rotate, with the paper sheet being fed between the rolls, there will be substantial variations of the temperature at the side wall outer surface that engages the paper sheet. The result is that for a period of time (e.g. one to two minutes) until the surface temperature around the entire side wall surface of the roll becomes uniform, disturbing vibration of the roll will occur, the result being that this portion of the product must be discarded or run at a much lower speed. As the rolls continue to rotate and pick up speed, then the "rimming" occurs, and the temperature around the entire side wall again becomes substantially uniform so that the operation can be carried on in a suitable manner.

In addition to the problem noted above of obtaining substantial uniformity of surface temperature along the outside surface of the side wall of the roll, there is also the overall consideration of optimizing the heat transfer from the heat transfer medium (generally steam) within the roll to the outside surface. One avenue which has been explored extensively to accomplish this is to remove the condensate (i.e. liquid water) from the interior of the roll as effectively as possible so that the liquid film that accumulates on the interior surface of the roll during the rimming condition is as thin as possible. However, the overall problem of obtaining proper heat transfer is complex, and certain facets of this will be discussed later in this text.

It is with the above consideration and others in mind that the apparatus and method of the present invention has been developed.

SUMMARY OF THE INVENTION

The roll assembly of the present invention is designed to engage a material to be processed in heat transfer relationship, such as a sheet of paper or the like.

The roll assembly comprises a roll structure mounted for rotation and defines an enclosed chamber to contain a condensable heat transfer medium. The roll structure comprises a cylindrical side wall having an outside generally cylindrical contact surface to engage the material in heat transfer relationship and an inside generally cylindrical surface which is exposed to the heat exchange medium in the chamber in heat exchange relationship. The medium condenses on the inside surface and heat is conducted through the side wall to the outside surface. First and second end walls are located at first and second ends of the side walls.

The inside surface of the side wall is formed with a plurality of elongate ridges defining elongate valleys between each pair of adjacent ridges to receive condensate that condenses from the medium on the inner surface and provide flow paths for the condensate. The inside surface further provides a collecting location in communication with the valleys to receive the flow of the condensate along the flow paths.

There is condensate collecting means to collect the condensate from the collecting location. Also there is a chamber inlet means through which the medium passes into the chamber and chamber outlet means through which condensate of the medium passes from the chamber.

In the preferred form, the ridges and valleys are aligned with a longitudinal center axis of the roll structure about which the roll structure rotates. Also, the ridges and valleys are formed so that the flow paths provided by the valleys slope away from the longitudinal axis toward the collecting location.

Further, in a preferred form the collecting location comprises a surface region recessed relative to the ridges and extending continuously in a 360° curve around the inner surface of the side wall. The condensate collecting means comprises a tubular member having an inlet position adjacent to the recess region.

Also, in the preferred form, the collecting location is positioned between two sets of ridges and valleys, with each set of ridges and valleys having outer locations spaced farther from the collecting location toward the end walls, and inner locations positioned adjacent to and capable of directing flow of condensate into, the collecting location. Also in a preferred form, the ridges have a crest portion closer to the longitudinal axis, extending along a lengthwise dimension of its related ridge, and ridge side surfaces extending away from the crest portion away from said longitudinal axis divergently. Thus, condensate forming on the crest portions of the ridges flows away from the longitudinal axis along said side surfaces, in a condition where said roll structure is rotating so that the condensate is in a rimming condition distributed substantially entirely around the interior surface of the roll.

In the particular configuration shown herein, the crest of the ridges have a narrower width dimension adjacent to the collecting locations, and the width dimension increases in a direction from the inner end of the ridges toward the outer end of the ridges.

Also, in the preferred embodiment shown herein, the side wall comprises an outer cylindrical shell, and at least one generally cylindrical insert positioned in heat transfer contact with the shell. The ridges and valleys are formed at the inside surface of the insert.

In the particular embodiment shown herein, the roll structure is a corrugating roll having an outer surface of a plurality of longitudinally extending ridges separated by recesses. Also, the insert itself may be made in two separate portions, spaced from one another, so that the collecting location is between the two separate insert portions and is defined by the interior surface of the shell.

In the method of the present invention, a roll assembly is provided such as noted above. While the roll is stationary, the condensate collecting on the interior surface of the roll flows into the valleys to the collecting location, where the condensate is removed. In the rimming condition, the centrifugal force causes the condensate to flow into the valleys and to the collecting locations where the condensate is removed. In both instances, there is improved heat transfer through the roll, and also more uniform heating throughout.

Other features of the present invention will be come apparent from the following detailed description.

BRIEF DESCRIPTION OF THE DRAWING

FIG. 16 is a longitudinal sectional view of a steam feed/condensate removal fitting for the embodiment of FIG. 11;

FIG. 17 is a sectional view, drawn to an enlarged scale, of an outside surface portion of the side wall of the roll shown in FIG. 12A, showing a modified form of the collecting area of the insert;

FIG. 18 is a view similar to FIG. 11, showing a modified form of the insert made as two separate portions, with the condensate collecting area being positioned therebetween;

DESCRIPTION OF THE PREFERRED EMBODIMENTS OF THE PRESENT INVENTION

Figure 1:
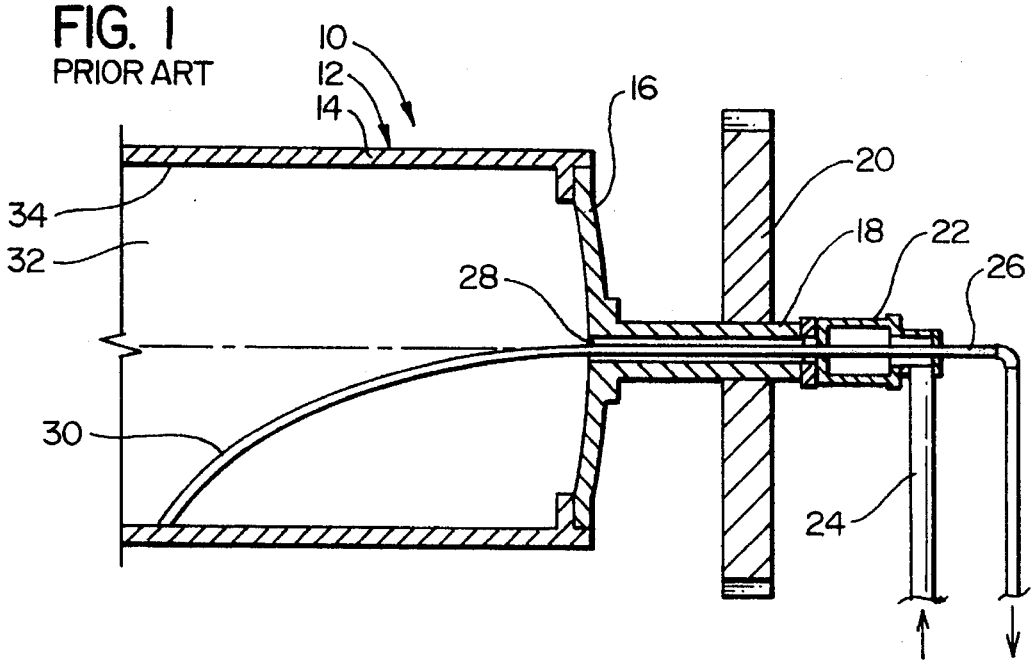
FIG. 1 PRIOR ART
FIG. 1 is a longitudinal sectional view of a portion of a prior art steam heated roll with one type of condensate removal (siphon) system.
Figure 2:
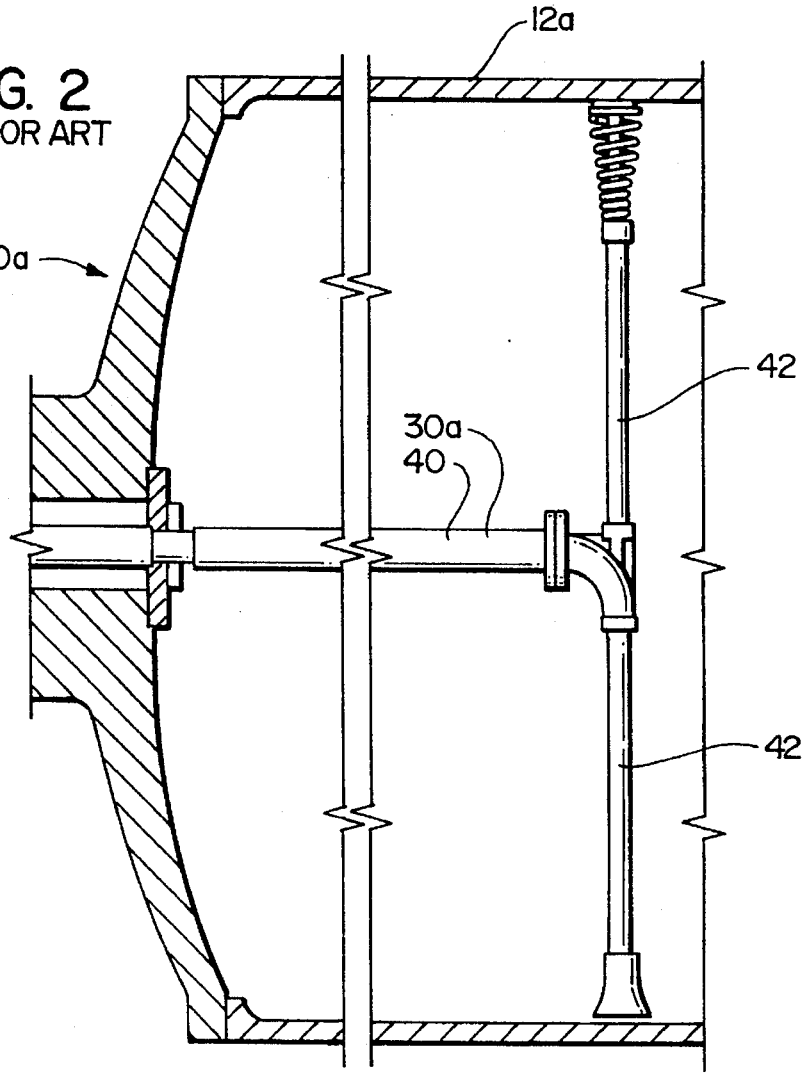
FIG. 2 PRIOR ART
FIG. 2 is a longitudinal sectional view of another prior art steam heated roll assembly having a different condensate removal device.
Figure 3:
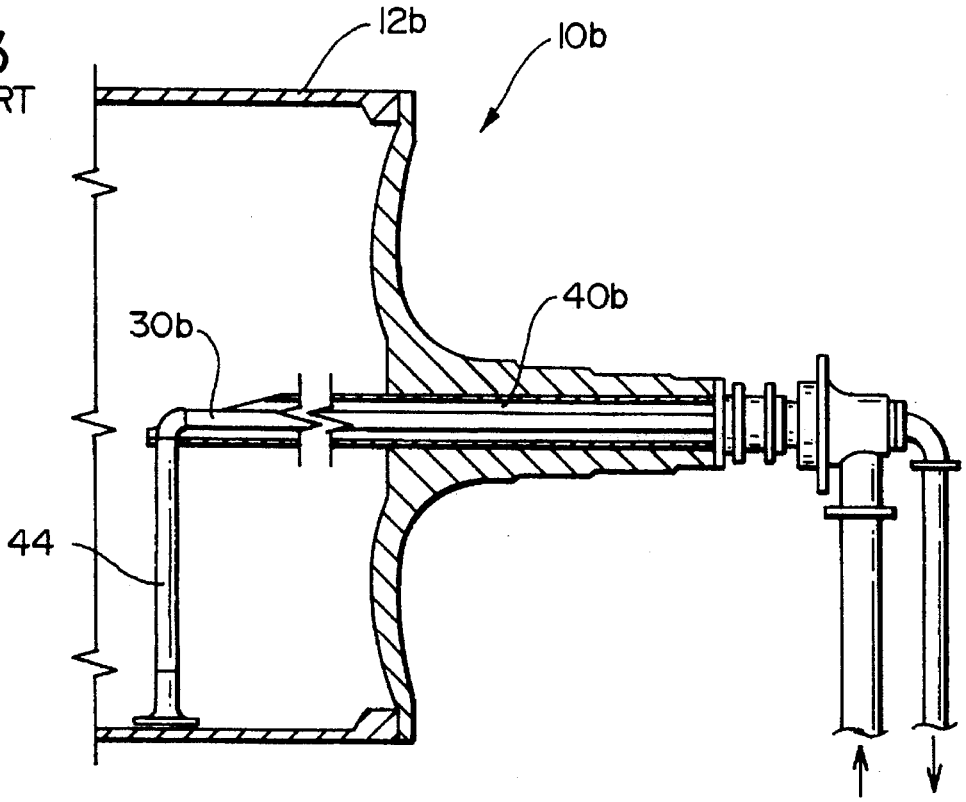
FIG. 3 PRIOR ART
FIG. 3 is a longitudinal sectional view showing yet a third prior art steam heated roll assembly.
Figure 4:
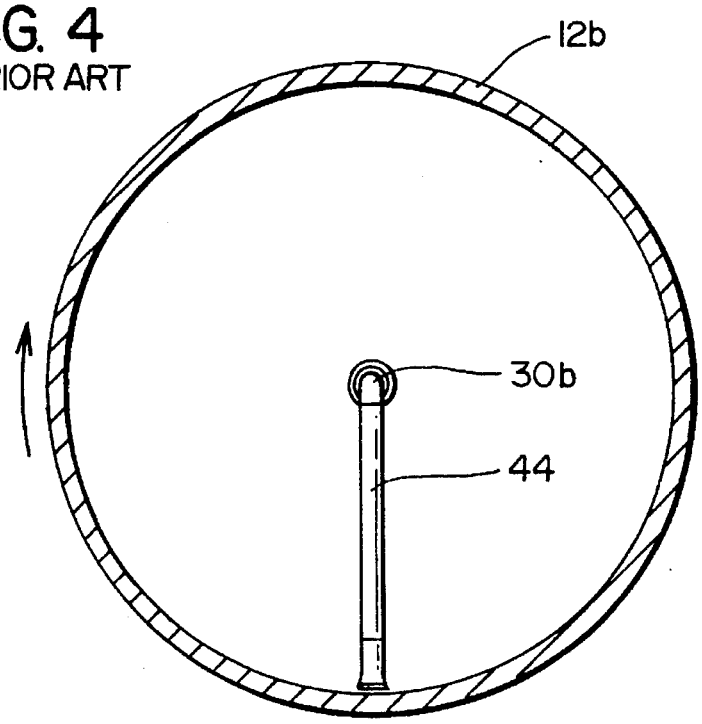
FIG. 4 PRIOR ART
FIG. 4 is a longitudinal sectional view of the apparatus shown in FIG. 3.
Figure 5:
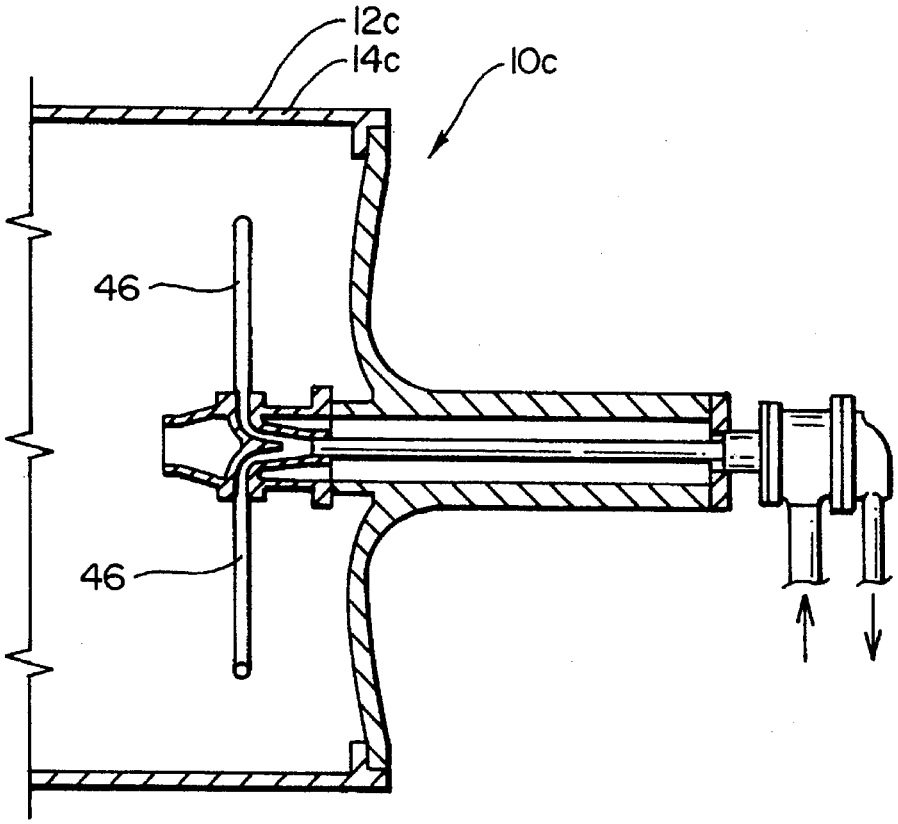
FIG. 5 PRIOR ART
FIG. 5 is a longitudinal sectional view of yet a fourth prior art steam heated roll.
Figure 6:
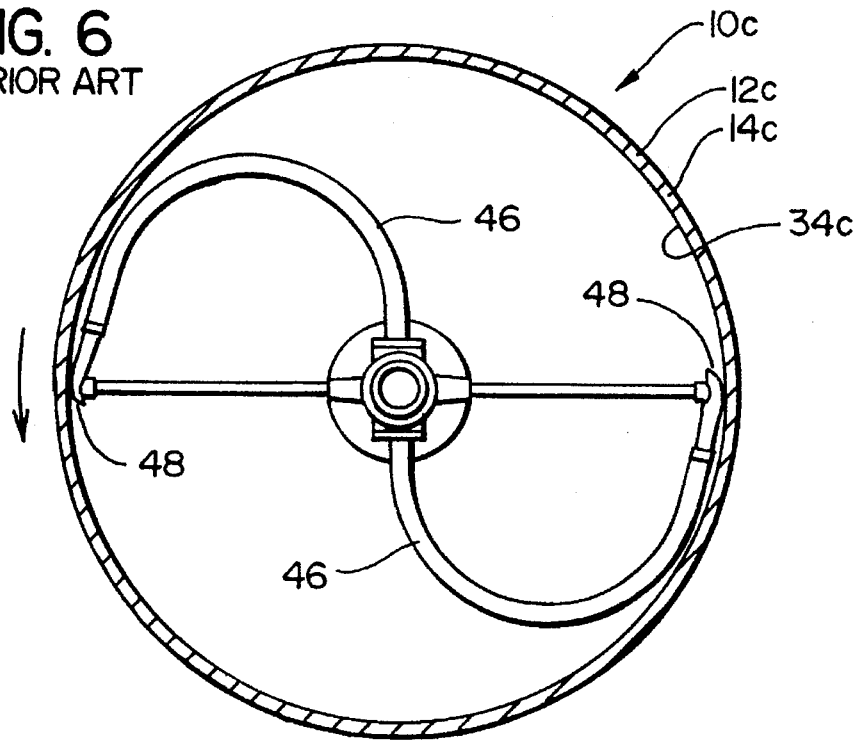
FIG. 6 PRIOR ART
FIG. 6 is a transverse sectional view of the apparatus of FIG. 5.
Figure 7:
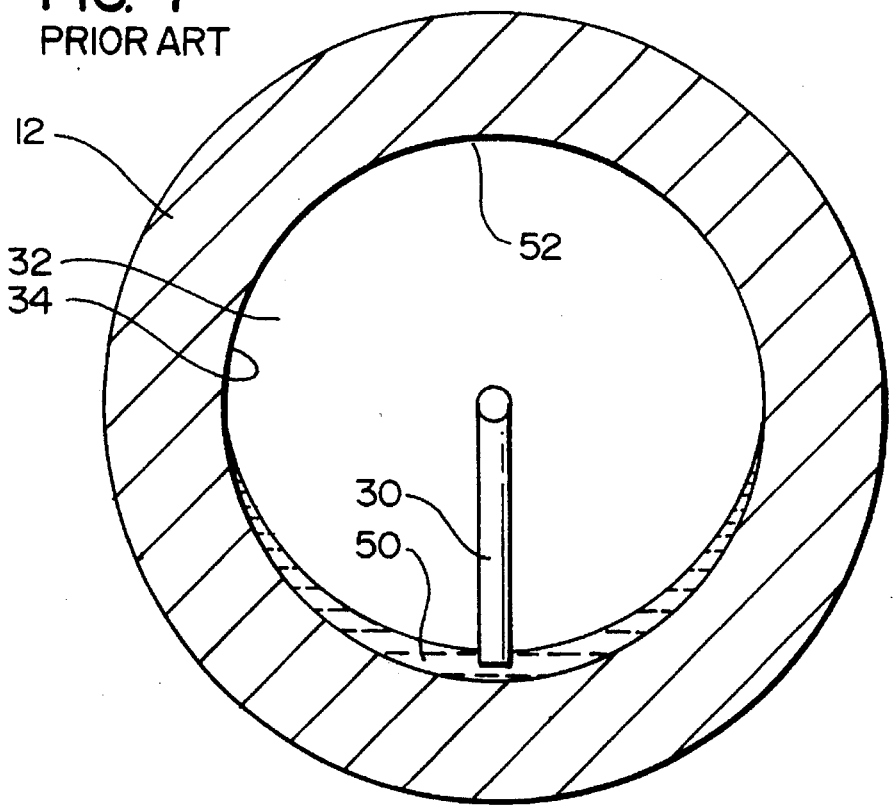
FIG. 7 PRIOR ART
FIG. 7 is a longitudinal sectional view of a prior art steam heated roll, which is stationary, thus forming a "puddling" condition.
Figure 8:
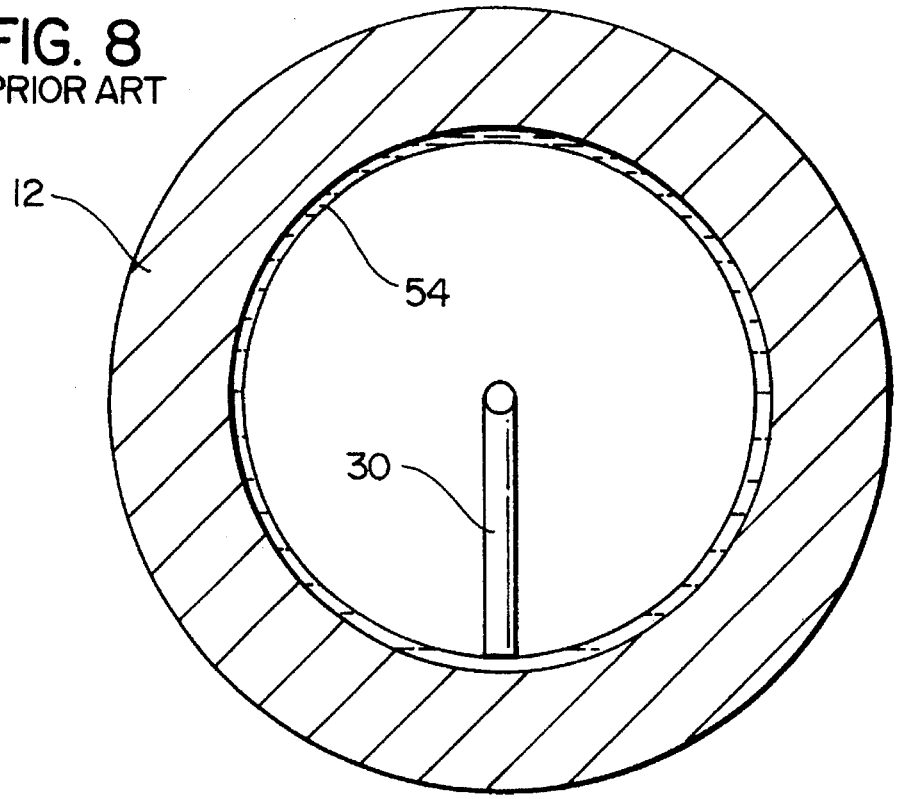
FIG. 8 PRIOR ART
FIG. 8 is a sectional view similar to FIG. 7, but showing the condensate film formed during the rimming condition.
Figure 9:
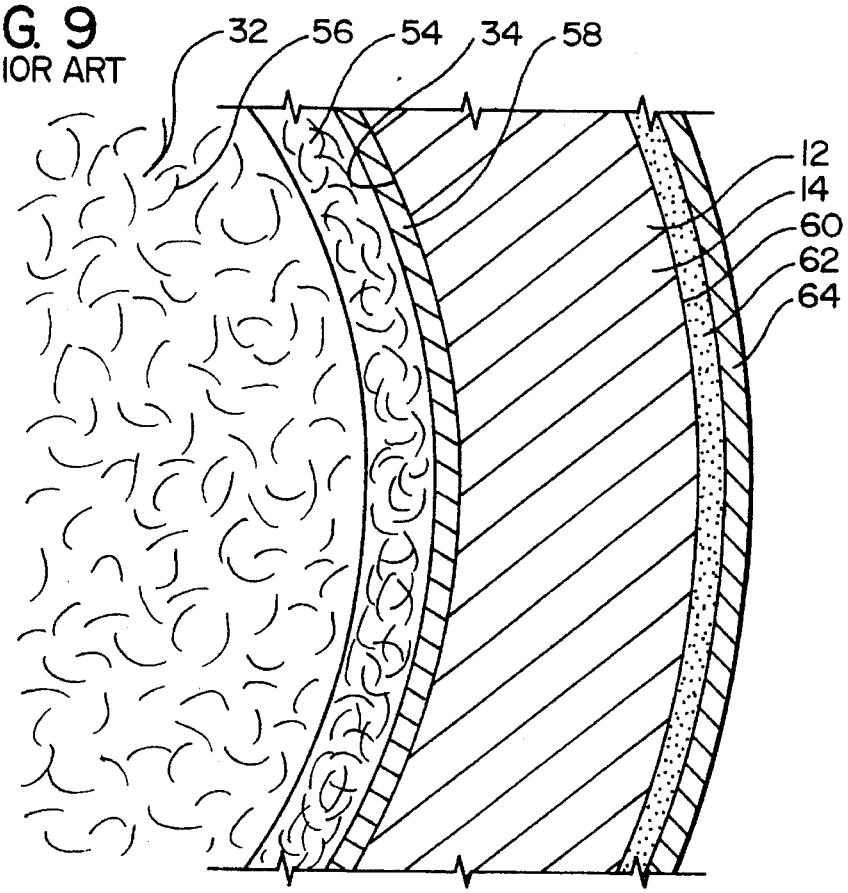
FIG. 9 PRIOR ART
FIG. 9 is a longitudinal sectional view of a portion of a prior art steam heated roll, showing the thickness dimensions (i.e. radial dimensions) of the various components substantially enlarged for purposes of illustration.
Figure 10:
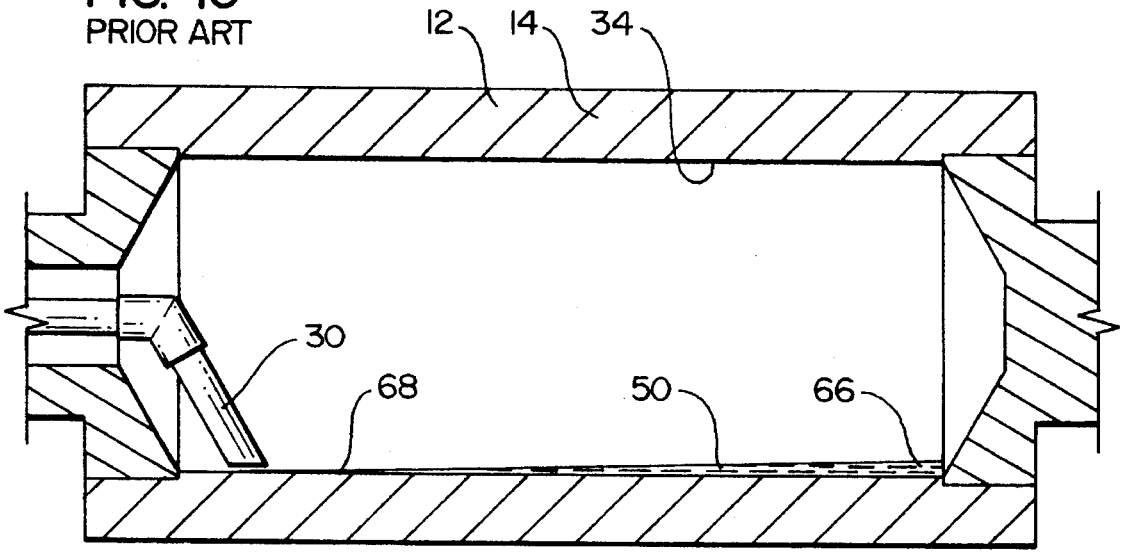
FIG. 10 PRIOR ART
FIG. 10 is a longitudinal sectional view of a prior art steam heated roll that is stationary, showing the depth distribution of the puddle formed at the bottom of the roll.
Figure 11:
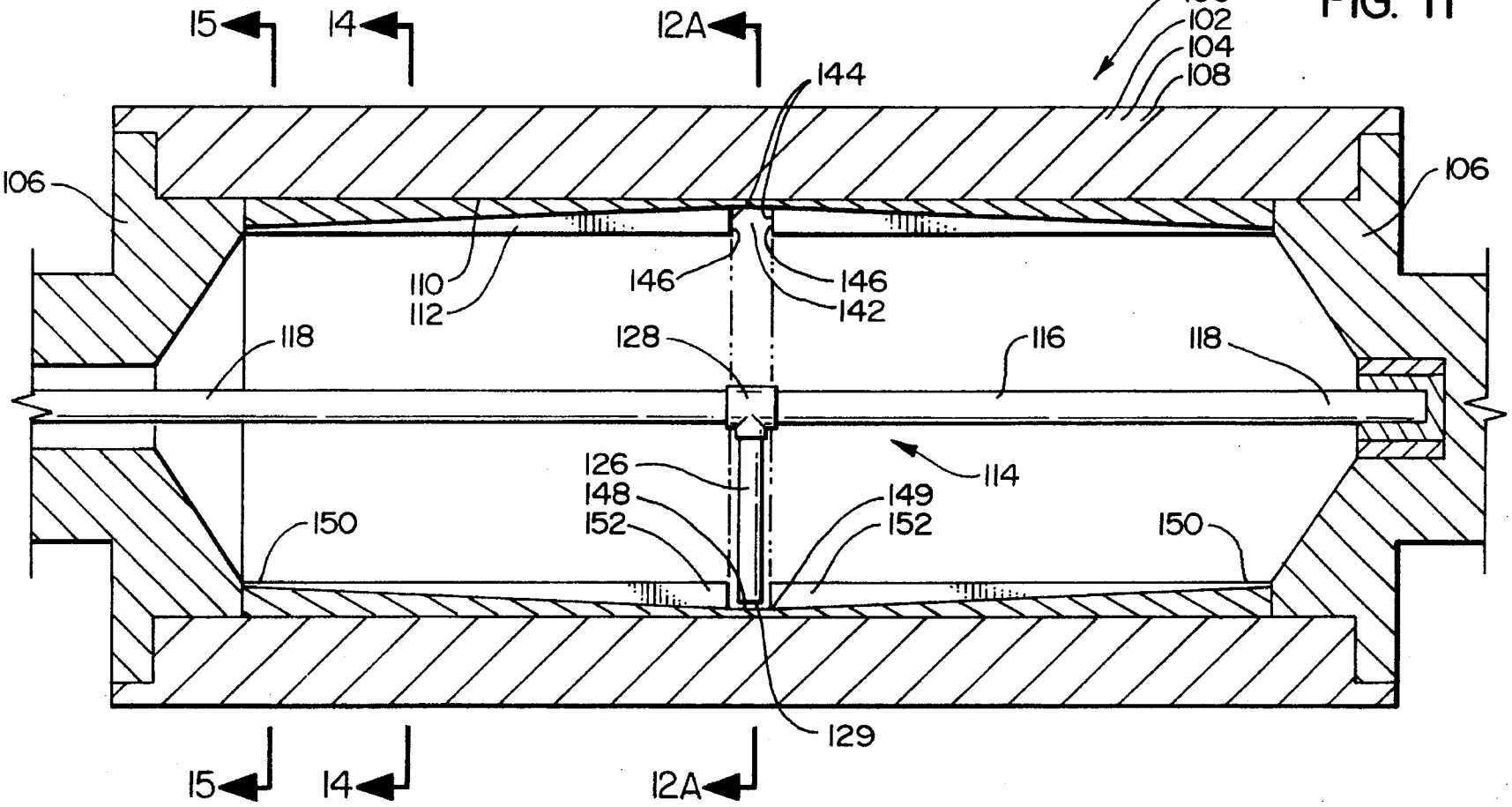
FIG. 11 is a longitudinal sectional view of a preferred embodiment of the present invention.

To describe the preferred embodiment of the present invention, reference is first made to FIGS. 11 through 17. As shown in FIG. 11, there is the roll assembly 100 of the present invention comprising a roll 102, having a cylindrical side wall 104 and two end walls 106. The side wall 104 comprises an outer cylindrical shell 108 having an inner cylindrical surface 110, and an insert 112 positioned snugly within the outer cylindrical shell 108. The configuration and function of this insert is particularly significant in the present invention, and this will be described in greater detail later herein.

There is a siphon assembly 114, comprising a centrally located, longitudinally extending pipe 116 supported at opposite ends 118 within the end walls 106. At one end wall 116, there is provided a steam inlet and condensate outlet fitting 120 which is, or may be, of prior art configuration. Such a fitting is illustrated in FIG. 17 and it can be seen to comprise a inner condensate removal pipe 122 surrounded by an annular steam inlet passage 124. This particular fitting shown in FIG. 16 already exists in the prior art, and is currently marketed by the Johnson Corporation. Accordingly, this fitting 120 will not be described in detail herein.

Connected to the center of the middle feed and support tube 116 is a siphon tube 126 which extends radially downwardly from a center coupling 128 for the pipe 116 and has at its lower end an inlet 129. While only one siphon tube 126 is shown herein, there could, of course, be additional siphon tubes and various arrangements of the same would be possible, as shown in the prior art in FIGS. 1 through 6, or variations of the same.

To turn our attention back to the roll insert 112, as indicated previously, the structure and functional features of this insert 112 are particularly significant in the present invention. In general, this insert 112 substantially improves the heat transfer characteristics of the roll 102 both with regard to improved rate of heat transfer (both in the rimming condition and the stationary "puddle" forming condition), and with regard to greater uniformity of temperature at the outer surface of the roll side wall 104.

The roll insert 112 is formed in a general configuration of a cylinder having open ends. As shown in FIGS. 12 and 13 The outer surface 133 of the insert 112 is cylindrically shaped and fits against the inside surface 110 of the outer side wall shell or cylinder 108 in close metal to metal contact so as to ensure optimized heat transfer between the two. The insert 112 is formed with two opposed sets of longitudinally extending grooves or valleys 130 which are distributed evenly around the entire inside surface of the insert 112. These grooves 130 are arranged parallel and adjacent to one another so as to form a plurality of longitudinally extending ridge members 131 separated by adjacent valleys 130.

In describing the arrangement of these ridges 131 and valleys 130, the term "upper" shall denote proximity to the longitudinal center axis 134 of the roll side wall 104, and the term "lower" shall denote a distance further away from the longitudinal center axis 134. The term "inner" shall refer to proximity to the longitudinal center location of the roll 102 (or shall denote a direction toward that location), while the term "outer" shall denote proximity to one or the other of the end walls 106 or a direction toward either of the two end walls 106.

Each ridge member 131 has an upper crest 136 formed by two adjacent walls 138 of that ridge member 131. Each valley 130 has a lower valley floor or apex line 140 which is formed by adjacent side walls 138 of adjacent ridge members 130. In FIGS. 12 and 13, the ridges 131 and valleys 130 are shown in transverse section across a longitudinal axis 134 at the center location of the roll 102.

The two sets of ridge members 131 and valleys 130 are separated at the longitudinal center of the roll 102 by a continuous circumferential collecting groove or recess 142, the two side walls 144 of which are formed by the terminal faces 146 of the central end portion of the ridge members 131. The floor 148 of the central circumferential groove 142 is a flat cylindrical surface following a continuous uniform 360° curve around the insert 112. In FIG. 11, the floor 148 of the recess 142 is shown as being at the same level as the lowermost location 149 of the apex line 140 of the valley where it meets the floor 148. In FIG. 17 there is shown a modified version where the floor, (indicated at 148*a*) of the recess 142*a* is made slightly lower than the apex line location 149*a* to facilitate draining the condensate fropm the valleys 130*a*.

Figure 15:
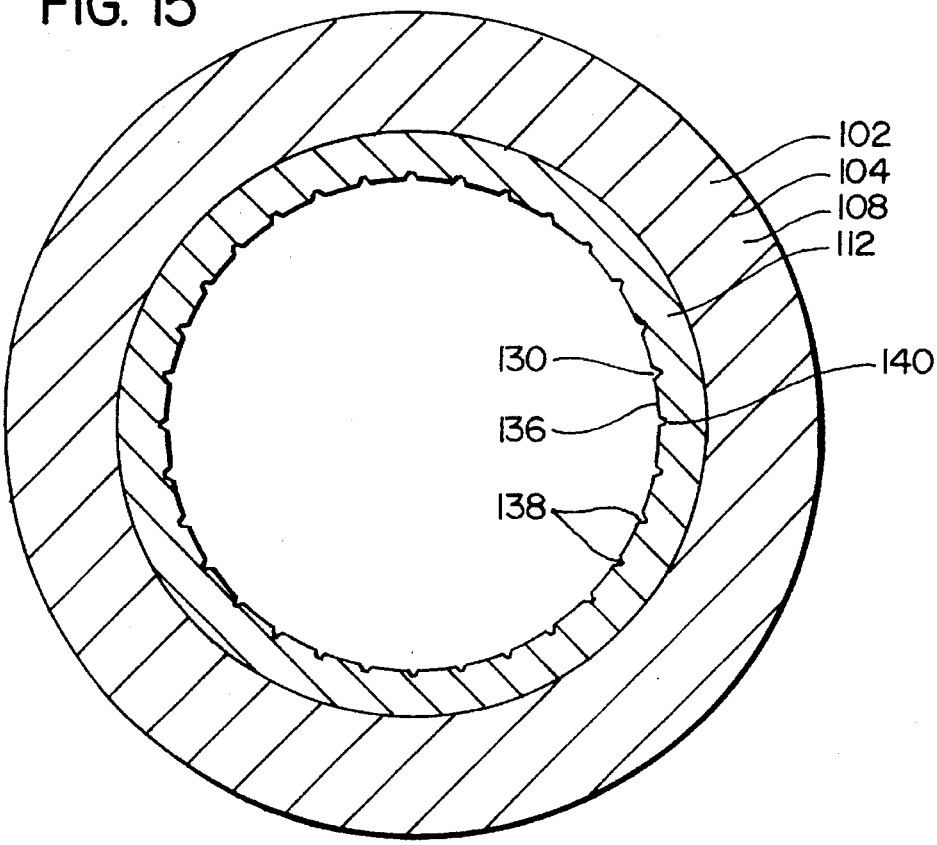
FIG. 15 is a sectional view taken along line 15—15 of FIGS. 11.

Also, each groove or valley 130 slopes slightly downwardly from outer end locations 150 to a center end location 152 adjacent to the center groove 142. More particularly, as can be seen in the cross-sectional view of FIG. 14, as the valley or groove 130 extends outwardly toward its related end wall 106, its lower apex line 140 slants upwardly, but the side walls 138 maintain their same angular orientation. Thus, the crest 136 of each ridge member 130 becomes wider, while the distance between the edges of each crest 136 becomes smaller. In a further end location as shown in FIG. 15, it can be seen that at the outer end of each groove 130, the depth of each valley 130 has diminished to only about one fifth to one tenth of the depth of the valley 132 at the center location.

OPERATION OF THE PREFERRED EMBODIMENT OF THE PRESENT INVENTION

Figure 12A:
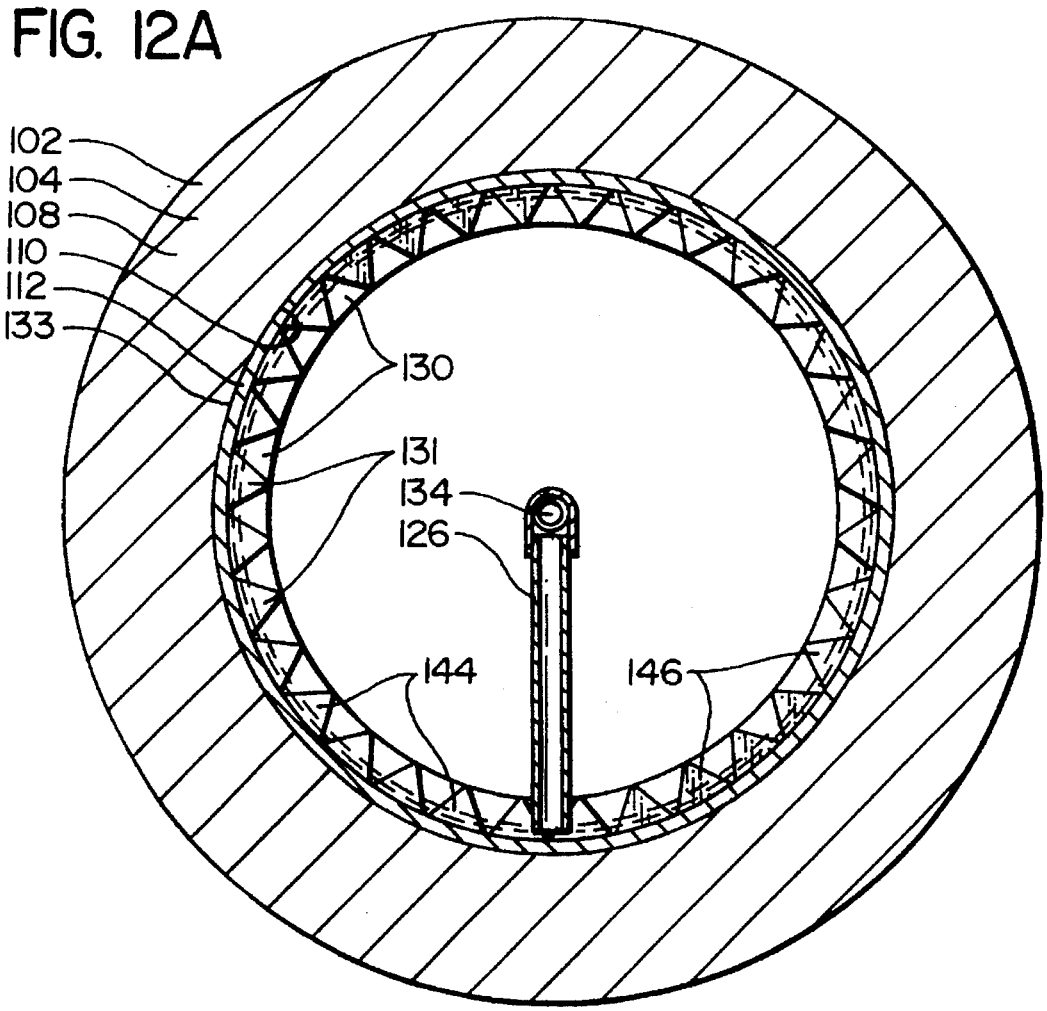
FIG. 12A is a sectional view taken along line 12—12 of FIG. 11, showing the roll in a rimming condition.
Figure 13A:
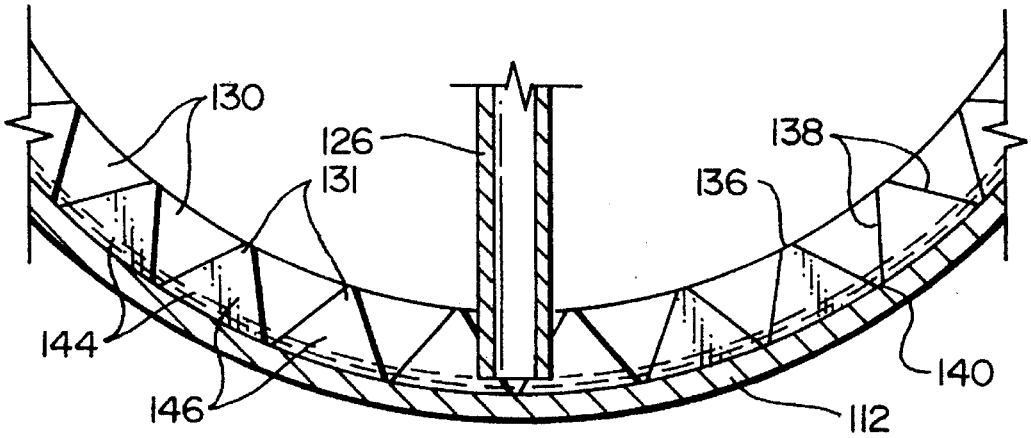
FIG. 13A is a transverse sectional view taken at the same location as FIG. 12A, but showing only a portion of the side wall insert, drawn to enlarged scale.
Figure 12B:
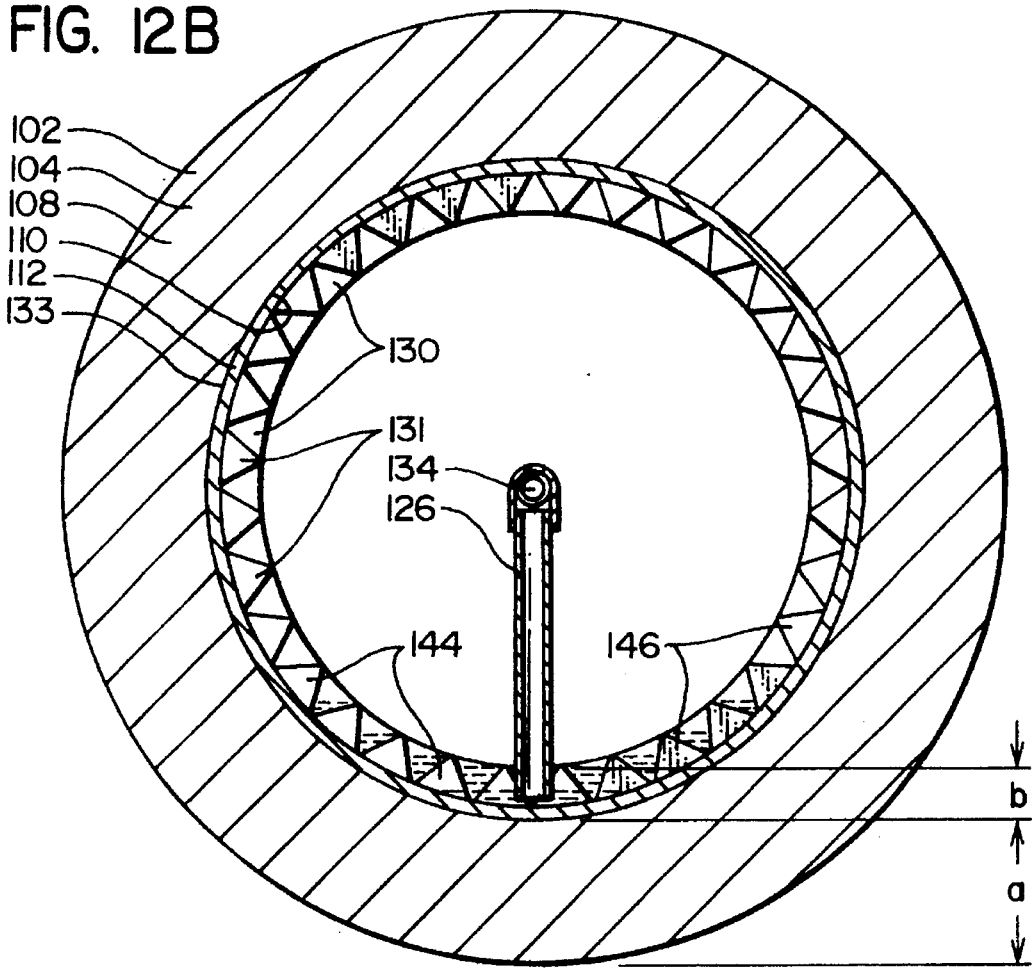
FIGS. 12B and 13B are views similar to FIGS. 12A and 13A, respectively, but showing the roll stationary in the "puddling" condition.

With reference to FIGS. 12A and 12B, let it first be assumed that the roll 102 is rotating at full speed so as to be in the rimming condition. It can be seen that the condensate will collect in the lower portion of each valley or groove 130. Since the valley floor or apex line at the bottom of each groove or valley 130 slopes "downwardly" (which means it slopes in a direction away from the longitudinal center axis 134 about which the roll rotates), the centrifugal force is in a radially outward direction. This causes the condensate to flow down the grooves or valleys 130 to the center collecting groove or recess 142, where the siphon tube 126 carries the condensate outwardly through the pipe 116.

The steam in the chamber 132 condenses on substantially all of the surface areas of the interior of the roll 102. As the condensate collects on the side walls 138 of each ridge 131, it flows downwardly into the area at the valley floor or apex line 140. Condensate which forms on the flattened portion of the crests 136 of each ridge 131 has a very short distance to flow laterally into the adjacent grooves 130. Thus, there is at most a very thin film of condensate that forms on those flattened areas of the crests 136, since the centrifugal force exerted on the film tends to cause the flow into the grooves or valleys 130.

Thus, it becomes evident that any film forming on any of the interior surface portion of the insert 112 tends to flow into the grooves, and then longitudinally along the grooves toward the center circumferential groove 142 to be extracted by the siphon 126. The overall result is that this diminishes the film thickness in most all parts of the interior of the roll insert 112 to a rather small fraction of the film thickness that would exist in a conventional prior art roll during the rimming condition.

To explore another facet of the heat transfer characteristics of the present invention, it is evident that with the formation of the valleys 130, there is increased total surface area of the interior surface of the insert 112. Since the rate of heat transfer has a functional relationship to the area on which the steam is condensing, this arrangement further enhances the rate of heat transfer.

Figure 13B:
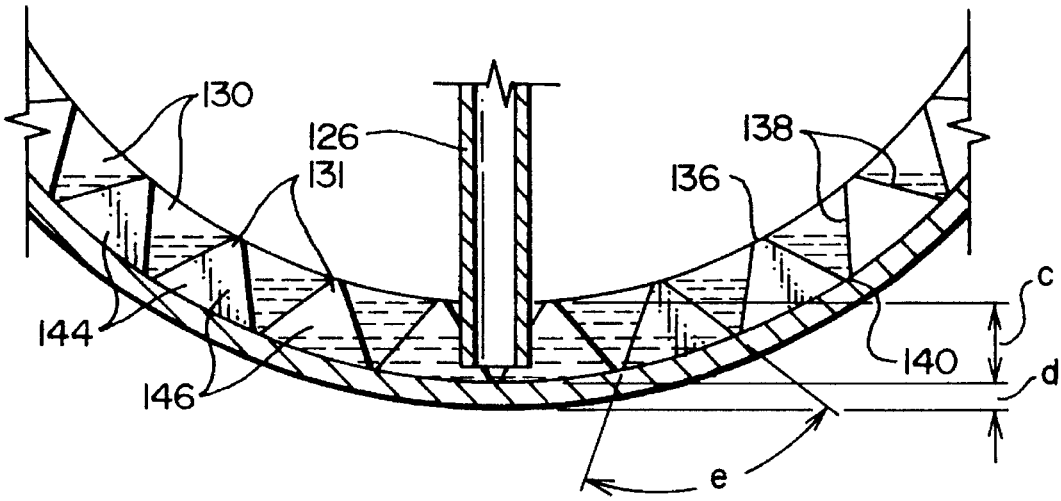
Figure 14:
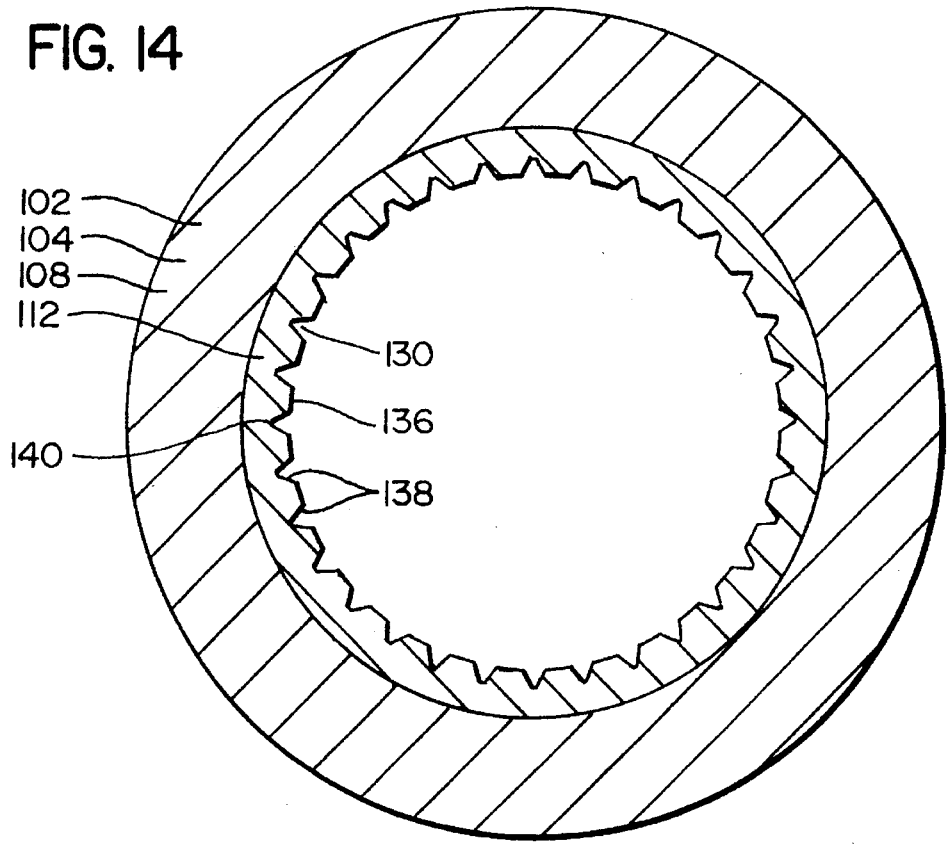
FIG. 14 is a sectional view taken at line 14—14 of FIG. 11.

Let us now examine the condition of the roll 102 when it is stationary so that a puddle forms in the bottom of the roll 102. Reference is made to FIGS. 12B and 13B. Since the valley floor or apex line 140 slopes from the end walls 106 toward the center collecting groove 142, there is gravity flow of the condensate collecting in the grooves 130 (which are positioned at a lower location) toward the center location, where the siphon 126 collects the condensate to discharge it to a location outside the roll 102. It is evident from viewing FIGS. 12B and 13B that the upper portion of the side walls 138 of the ridges 131 at a lower position have condensate only in the lower portion of each groove or valley 130, and substantial portions of the side surfaces 138 are exposed directly to the steam for optimum heat transfer. Also, at the flattened areas of the crests of the ridges 131 (see FIGS. 14 and 15), there is a very short distance for the condensate to travel to descend into the adjacent grooves 130. Thus, any film that forms in these locations would be relatively small.

To review further the heat transfer characteristics of the present invention, let us first consider approximate practical dimensions for a roll such as shown in FIGS. 12A–B and FIG. 13A–B.

A typical corrugating roll 102 could be, for example, two and half meters long, and have an inside diameter of possibly two hundred fifty millimeters. The thickness (indicated at "a") of the outer steel shell 104 could be, for example, fifty millimeters. The total thickness (indicated at "b") of the insert 112 could be, for example, about twenty millimeters. The total depth of each groove or valley 120 (indicated at "c") in FIG. 13B is approximately 15 millimeters. The thickness dimension from the valley floor or apex line 140 to the outside surface of the insert 112 (indicated at "d") in FIG. 13*b* is approximately five millimeters.

While the depth of each groove 130 is fifteen millimeters at the maximum, the depth of each groove 130 at its outer end (adjacent to the end wall 106) is only about three millimeters. Obviously, these dimensions, and also the configuration of the grooves could be varied. For example, the valley floor or apex line 140 could be made somewhat wider or somewhat rounded, and the same is true of the ridge crests 136. For ease in manufacture, the slope of the ridge side walls 138 is made uniform (so as to make an included angle) indicated at "e" in FIG. 13B of approximately sixty degrees. This slope could be varied, and possibly be made different at certain locations. Or there could be a compound slope, such as forming the slope of the side walls 138 near the end walls at a shallower angle.

Desirably, for economic and structural reasons, the outer shell 108 is made of steel. The insert 112 is desirably made of aluminium, both for ease of manufacture costs and also thermal conductivity.

Thermal conductivity can be measured according to the following relationship, namely:

BTU'S/(hr) (sq. ft) (°F.)/per ft of thickness According to this measure of thermal conductivity, the thermal conductivity of certain materials are given below.

| | |
|---|---|
| Aluminum | 121 |
| Steel | 25.6 |
| Copper | 222 |
| Dural (an alloy) | 119 |
| Water | 0.38 |

To put these relationships in perspective, let it be assumed that it is desired to transfer one thousand BTU's per square feet per hour through a film of water which is one millimeter thick. To accomplish this, there would have to be a temperature deferential of 8.6° F. imposed. To accomplish this same rate of heat transfer for steel which is fifty millimeters thick, it would take only 6.5° F. temperature differential. To accomplish this rate of heat transfer for aluminum that is five millimeters thick, the temperature differential required would be 0.14° F.

An analysis of these relationships, relative to the distribution of the condensate and the condensate film in the rimming condition and the stationary "puddling" condition of the roll 102, clearly indicates that not only is the rate of heat transfer enhanced, but also the uniformity of the heat transfer (particularly to solve the problems of temperature differential at the outside surface at the "puddle" location).

First, in the rimming condition, in the prior art roll 12 there is generally a film thickness between about one millimeter to three millimeters. On the other hand, in the present invention, during rimming, the great majority of the inside surface of the insert 112 has substantially little if any of the condensate film thereon, since the condensate collects in the apex lines 140 of the grooves 130. It is apparent that even with the significant effect of a one millimeter layer of condensate, this provides significant improvement in heat transfer.

In the puddling condition where the roll 102 is stationary, the condensate that collects in the grooves or valleys 130 is constantly flowing toward the center location. Further, the side walls 138 have a relatively steep slope, and thus have very little film condensate thereon. At the very central portion of the roll where the grooves or valleys 130 have a maximum depth, even though there will be a certain amount of collection in the lower part of these grooves 130, substantial portions of the side walls 138 will have very little (if any) condensate remaining thereon. Thus, even at the puddle location itself, there are significant areas having little if any film, thus providing a relatively large area for the flow of thermal energy without being obstructed by a layer of film condensate.

A further modified form of the present invention is shown in FIG. 18, where the insert 112 is made as two separate sections 112*b* and 112*c*. This is accomplished by deleting the material of the insert 112 that is at the location of the recess so that the inside surfaces 146*b* of the inner side walls of the insert sections 112*b* and 112*c* are spaced from one another and the exposed middle inside surface portion 152 of the inner surface of the shell 108*b* forms the surface at which the condensate collects.

Figure 19:
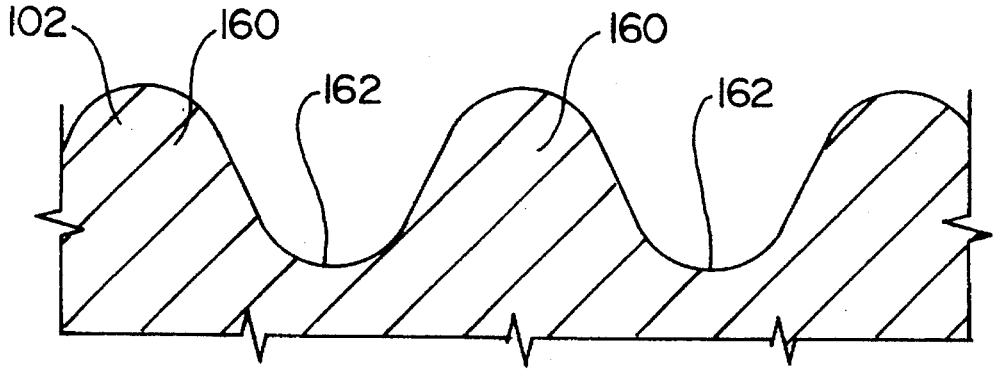
FIG. 19 illustrates in transverse section the corregated surface of the roll used in one preferred form of the present invention.

The preferred embodiment was specifically designed for a corrugating roll, but within the broader scope of the present invention, the basic concepts of the present invention could be applied to other types of rolls such as drying rolls for pulp or paper, etc. To illustrate the configuration of a corrugating roll of the specifically disclosed embodiment, reference is made to FIG. 19 which is drawn to enlarged scale and shows a portion of the roll 102 circled at FIG. 112. It can be seen that there is on the exterior surface a series of ridges 160 separated by recessed portions or grooves 162. As indicated previously, a matching set of rolls is positioned one against the other with the ridges and grooves of the rolls that are interfitting with one another to give the paper or cardboard its corrugated configuration.

Figure 20:
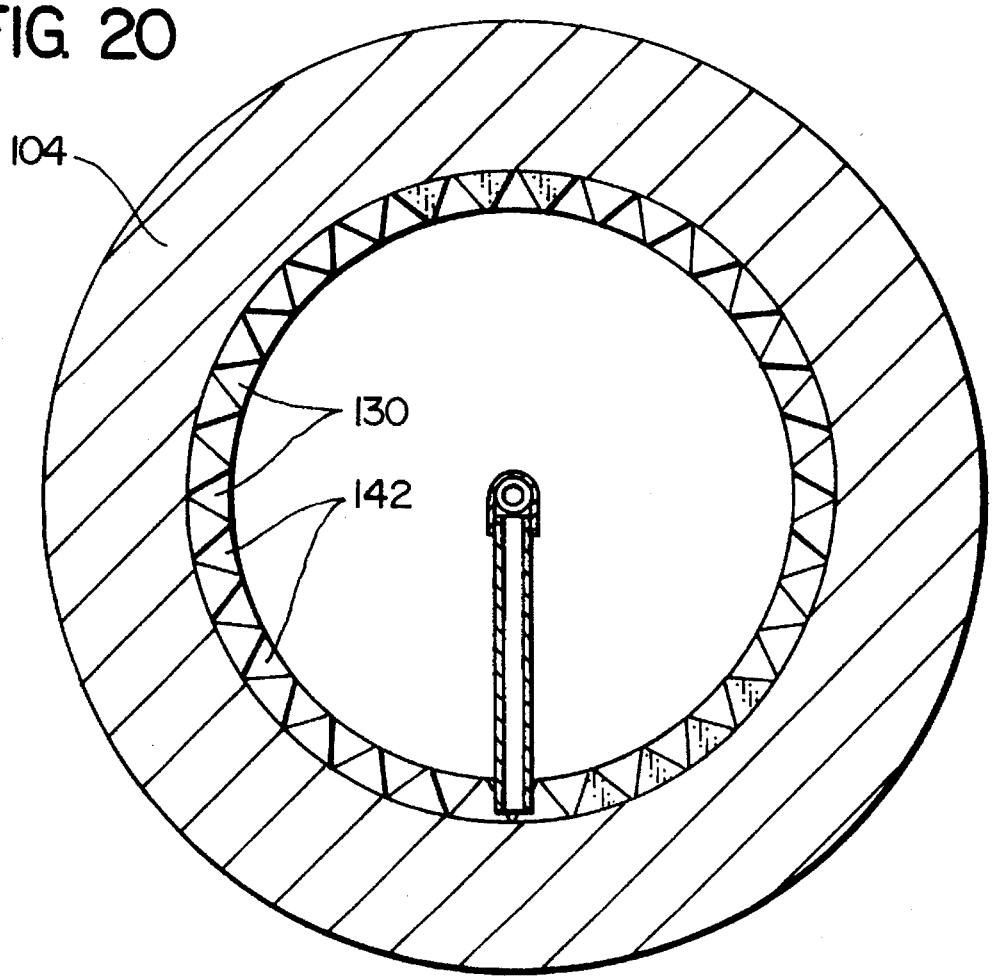
FIG. 20 is a view similar to FIG. 12A, but showing the roll side wall 104 made as a single casting.

Also, it is to be understood that the side wall 104, instead of being made in two parts (i.e. as a shell 108 and an insert 112), this could be made as a single casting, where the grooves 130 and the collecting groove 142 can simply be machined into the interior surface. This is illustrated in FIG. 20.

It is obvious that other modifications could be made in the present invention without departing form the basic teachings thereof, in addition to the modification shown in FIG. 18. For example, the insert 112 of the preferred embodiment is shown as having only two sets of grooves flowing toward a center location. It would of course also be possible to provide two or more of such inserts 112 of shorter axial length and position these at endwise abutment in the shell 108. Various other modification could also be made.

What is claimed:

1. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surface;

ii. first and second end walls at first and second ends of said side walls, respectively;

b. the inside surface of the side wall being formed with a plurality of elongate ridges defining elongate valleys between each pair of adjacent ridges to receive condensate that condenses from said medium on said inner surface and provide flow paths for said condensate, said inside surface further providing a collecting location in communication with said valleys to receive the flow of the condensate along the flow paths;

c. condensate collecting means to collect the condensate from the collecting location;

d. chamber inlet means through which said medium passes into said chamber and chamber outlet means through which condensate of said medium passes from said chamber;

e. said roll structure having a longitudinal center axis about which said roll structure rotates, and said ridges and valleys are aligned with said longitudinal axis;

f. said ridges and valleys are formed so that the flow paths provided by the valleys slope away from said longitudinal axis toward said collecting location.

2. The assembly as recited in claim 1, wherein said collecting location comprises a surface region recessed relative to said ridges and extending continuously in a 360° curve around the inner surface of the side wall, and said condensate collecting means comprises a tubular member having an inlet positioned adjacent to said recessed region.

3. The assembly as recited in claim 2, wherein said collecting location is positioned between two sets of ridges and valleys, with each set of ridges and valleys having outer locations spaced further from said collecting location toward said end walls, and inner locations positioned adjacent to, and capable of directing flow of condensate into, said collecting location.

4. The assembly as recited in claim 3, wherein each of said ridges has a crest portion closer to said longitudinal axis, extending along a lengthwise dimension of its related ridge, and ridge side surfaces extending away from said crest portion away from said longitudinal axis divergently, whereby condensate forming on the crest portions of the ridges flows away from said longitudinal axis along said side surfaces, in a condition where said roll structure is rotating so that said condensate is in a rimming condition distributed substantially entirely around the interior surface of the side wall.

5. The assembly as recited in claim 4, wherein the crests of the ridges have a narrower width dimension adjacent to said collecting location, and said width dimension increases in a direction from the inner end of the ridges toward the outer end of the ridges.

6. The apparatus as recited in claim 1, wherein said roll structure is a corrugating roll having at the outer surface a plurality of longitudinally extending ridges separated by recesses.

7. A method of processing a material in heat transfer relationship, such as a sheet of paper, said method comprising:

a. providing a roll structure mounted for rotation and defining an enclosed chamber, said roll structure comprising:

i. a cylindrical side wall having an outside generally cylindrical contact surface inside generally cylindrical surface;

ii. first and second end walls at first and second ends of said side walls; respectively, b. forming the inside surface of the side wall with a plurality of elongate ridges defining elongate valleys between each pair of adjacent c. directing a condensable heat exchange medium into said chamber in heat exchange relationship with said inside surface, in a manner that the medium condenses on the inside surface to form condensate and heat is conducted through the side wall to the outside surface, with the valleys receiving the condensate that condenses from said medium on said inner surface and directing the condensate in flow paths for said condensate to a collecting location in the chamber;

d. collecting the condensate from the collecting location and directing the condensate from said chamber through chamber outlet;

e. placing said material in contact with said roll, and rotating said roll as the medium is condensing in the chamber;

f. said roll structure having a longitudinal center axis about which said roll structure rotates, and said ridges and valleys are aligned with said longitudinal axis;

g. said ridges and valleys are formed so that the flow paths provided by the valleys slope away from said longitudinal axis toward said collecting location.

8. The method as recited in claim 7, wherein said condensate is collected at a surface region recessed relative to said ridges and extending continuously in a 360° curve around the inner surface of the side wall, and collecting said condensate by means of a tubular member having an inlet positioned adjacent to said recessed region.

9. The method as recited in claim 7 comprising making said side wall as an outer cylindrical shell, placing at least one generally cylindrical insert in said shell positioned in heat transfer contact with said shell, and forming said ridges and valleys as an inside surface of said insert.

10. The method as recited in claim 7, wherein there is a plurality of said roll structures which are corrugating rolls having at their outer surfaces a plurality of longitudinally extending ridges separated by recesses, and directing material in sheet form between said rolls.

11. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surface;

ii. first and second end walls at first and second ends of said side walls; respectively, b. the inside surface of the side wall being formed with a plurality of elongate ridges defining elongate valleys between each pair of adjacent ridges to receive condensate that condenses from said medium on said inner surface and provide flow paths for said condensate, said inside surface further providing a collecting location in communication with said valleys to receive the flow of the condensate along the flow paths;

c. condensate collecting means to collect the condensate from the collecting location;

d. chamber inlet means through which said medium passes into said chamber and chamber outlet means through which condensate of said medium passes from said chamber;

e. side wall comprising an outer cylindrical shell, and at least one generally cylindrical insert positioned in heat transfer contact with said shell, said ridges and valleys being formed at an inside surface of said insert;

f. said insert being made of two insert sections, spaced from one another to leave a circumferential recess which is positioned between said insert sections and which functions as a collecting location.

12. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surface;

ii. first and second end walls at first and second ends of said side walls; respectively, b. the inside surface of the side wall being formed with a plurality of elongate ridges defining elongate valleys between each pair of adjacent ridges to receive condensate that condenses from said medium on said inner surface and provide flow paths for said condensate, said inside surface further providing a collecting location in communication with said valleys to receive the flow of the condensate along the flow paths;

c. condensate collecting means to collect the condensate from the collecting location;

d. chamber inlet means through which said medium passes into said chamber and chamber outlet means through which condensate of said medium passes from said chamber;

e. said collecting location comprising a surface region recessed relative to said ridges and extending continuously in a 360° curve around the inner surface of the side wall, and said condensate collecting means comprises a tubular member having an inlet positioned adjacent to said recessed region;

f. said collecting location being positioned between two sets of ridges and valleys, with each set of ridges and valleys having outer locations spaced further from said collecting location toward said end walls, and inner locations positioned adjacent to, and capable of directing flow of condensate into, said collecting location.

13. The assembly as recited in claim 12, wherein each of said ridges has a crest portion closer to said longitudinal axis, extending along a lengthwise dimension of its related ridge, and ridge side surfaces extending away from said crest portion away from said longitudinal axis divergently, whereby condensate forming on the crest portions of the ridges flows away from said longitudinal axis along said side surfaces, in a condition where said roll structure is rotating so that said condensate is in a rimming condition distributed substantially entirely around the interior surface of the side wall.

14. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surface;

ii. first and second end walls at first and second ends of said side walls respectively;

iii. said roll structure having a longitudinal center axis about which said roll structure rotates;

b. the inside surface of the side wall being formed with a plurality of elongate valleys to receive condensate that condenses from said medium on said inner surface and provide flow paths for said condensate, said inside surface further providing a collecting location in communication with said valleys to receive the flow of the condensate along the flow paths;

c. said flow paths each having an upstream flow path portion and a downstream flow path portion into which condensate flows from its related upstream flow path portion, said upstream flow path portions being closer to said longitudinal axis than said downstream flow path portions, said downstream flow path portions leaving into said collecting location at a plurality of downstream flow exit locations positioned at circumferentially spaced locations around said collecting location;

d. condensate collecting means to collect the condensate from the collecting location;

e. chamber inlet means through which said medium passes into said chamber and chamber outlet means through which condensate of said medium passes from said chamber.

15. The assembly as recited in claim 14, wherein said collecting location comprises a collection surface region which extends continuously in a 360° curve around said inside cylindrical surface of the roll structure.

16. The assembly as recited in claim 15, wherein said collecting surface is spaced further from said longitudinal axis than said downstream flow path portions.

17. The assembly as recited in claim 16, wherein said downstream flow path portions each have a substantial alignment component parallel to said longitudinal center axis.

18. The assembly as recited in claim 15, wherein said downstream flow path portions each have a substantial alignment component parallel to said longitudinal center axis.

19. The assembly as recited in claim 14, wherein said downstream flow path portions each have a substantial alignment component parallel to said longitudinal center axis.

20. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having an outside generally cylindrical contact surface to engage said material in heat transfer relationship and an inside generally cylindrical surface which comprises a major heat exchange surface area that is exposed to the heat exchange medium in said chamber in heat exchange relationship therewith whereby the medium condenses on the inside surface and heat is conducted through the side wall to the outside surface;

ii. first and second end walls at first and second ends of said side walls respectively;

iii. said roll structure having a longitudinal center axis about which said roll structure rotates;

b. the inside surface of the side wall being formed with a plurality of elongate valleys positioned further from said longitudinal axis than said major heat exchange surface area to receive condensate that condenses from said medium on said major heat exchange surface area and provide flow paths for said condensate, said inside surface further providing a collecting location in communication with said valleys to receive the flow of the condensate along the flow paths:

c. said flow paths each having an upstream flow path portion and a downstream flow path portion into which condensate flows from its related upstream flow path portion, said downstream flow path portions leading into said collecting location, at least the downstream flow path portions having a substantial alignment component parallel to said longitudinal center axis;

d. condensate collecting means to collect the condensate from the collection location;

e. chamber inlet means through which said medium passes into said chamber and chamber outlet means which condensate of said medium passes from said chamber;

f. said flow paths each having an upstream flow portion and a downstream flow path portion into which condensate flows from its related upstream flow path portion, said upstream flow path portions being closer to said longitudinal axis than said downstream flow path portions.

21. A method of processing a material in heat transfer relationship, such as a sheet of paper, said method comprising:

a. providing a roll structure mounted for rotation and defining an enclosed chamber, said roll structure comprising:

i. a cylindrical side wall having an outside generally cylindrical contact surface inside generally cylindrical surface;

ii. first and second end walls at first and second ends of said side walls, respectively;

iii. said roll structure having a longitudinal center axis about which said roll structure rotates;

b. forming the inside surface of the side wall with a plurality of elongate valleys defining a plurality of flow paths, said flow paths each having said upstream flow path portion and a downstream flow path portion into which condensate flows from its related upstream flow path portion, and upstream flow path portions being closer to said longitudinal axis than said downstream flow path portions, said downstream flow path portions leading into said collection location at a plurality of downstream flow exit locations positioned at circumferentially spaced locations around said collecting location;

c. directing a condensable heat exchange medium into said chamber in heat exchange relationship with said inside surface, in a manner that the medium condenses on the inside surface to form condensate and heat is conducted through the side wall to the outside surface, with the valleys receiving the condensate that condenses from said medium on said inner surface and directing the condensate in flow paths for said condensate to a collecting location in the chamber;

d. collecting the condensate from the collecting location and directing the condensate from said chamber through chamber outlet;

e. placing said material in contact with said roll, and rotating said roll as the medium is condensing in the chamber.

22. The assembly as recited in claim 21, wherein said collecting location comprises a collection surface region which extends continuously in a 360° curve around said inside cylindrical surface of the roll structure.

23. The assembly as recited in claim 21, wherein said downstream flow path portions each have a substantial alignment component parallel to said longitudinal center axis.

24. A method of processing a material in heat transfer relationship, such as a sheet of paper, said method comprising:

a. providing a roll structure mounted for rotation and defining an enclosed chamber, said roll structure comprising:

i. a cylindrical side wall having an outside generally cylindrical contact surface inside generally cylindrical surface;

ii. first and second end walls at first and second ends of said side walls, respectively;

iii. said roll structure having a longitudinal center axis about which said roll structure rotates;

b. forming the inside surface of the side wall with a plurality of valleys which are further from said longitudinal axis than said inside surface and which define a plurality of flow paths, said flow paths each having an upstream flow path portion and a downstream flow path portion into which condensate flows from its related upstream flow path portion, said downstream flow path portions leading into said collecting location, at least the downstream flow path portions having a substantial alignment component parallel to said longitudinal center axis;

c. directing a condensable heat exchange medium into said chamber in heat exchange relationship with said inside surface, in a manner that the medium condenses on the inside surface to form condensate and heat is conducted to form condensate and heat is conducted through the side wall to the outside surface, with the valleys receiving the condensate that condenses from said medium on said inner surface, and directing the condensate in flow paths for said condensate to a collecting location in the chamber;

d. collecting the condensate from the collecting location and directing the condensate from said chamber through a chamber outlet;

e. placing said material in contact with said roll, and rotating said roll as the medium is condensing in the chamber;

f. said flow paths each having an upstream flow portion and a downstream flow path portion into which condensate flows from its related upstream flow path portion, said upstream flow path portions being closer to said longitudinal axis than said downstream flow path portions.

* * * * *